United States Patent [19]

Dernedde et al.

[11] 4,138,201

[45] Feb. 6, 1979

[54] PUMP FOR USE IN NUCLEAR REACTOR PLANTS AND ANCHORING MEANS THEREFOR

[75] Inventors: Robert Dernedde, Frankenthal; Wolfgang Schneider, Hessheim, both of Fed. Rep. of Germany

[73] Assignee: KSB Kernkraftwerkspumpen GmbH, Frankenthal, Fed. Rep. of Germany

[21] Appl. No.: 438,034

[22] Filed: Jan. 30, 1974

[30] Foreign Application Priority Data

Feb. 2, 1973 [DE] Fed. Rep. of Germany ..... 2305123

[51] Int. Cl.[2] ..... F01D 25/24; G21C 9/00

[52] U.S. Cl. ..... 415/219 C; 176/38; 176/65; 415/136; 417/424; 417/360

[58] Field of Search ..... 415/219 C, DIG. 7, 134, 415/136, 206; 417/424, 360; 176/38, 65, 87; 138/95

[56] References Cited

U.S. PATENT DOCUMENTS

| | | | |
|---|---|---|---|
| 3,437,047 | 4/1969 | Walsh et al. | 415/219 C |
| 3,476,488 | 11/1969 | Chambert | 415/219 C |
| 3,859,008 | 1/1975 | Wieser | 415/219 C |
| 3,947,154 | 3/1976 | Klepp et al. | 417/424 |
| 3,977,808 | 8/1976 | Schiele et al. | 176/38 |

FOREIGN PATENT DOCUMENTS

| | | | |
|---|---|---|---|
| 1053647 | 3/1959 | Fed. Rep. of Germany | 417/424 |
| 2305123 | 8/1974 | Fed. Rep. of Germany | 415/219 C |
| 1151742 | 5/1969 | United Kingdom | 417/424 |

*Primary Examiner*—C. J. Husar
*Attorney, Agent, or Firm*—Michael J. Striker

[57] ABSTRACT

The housing of the primary recirculating pump in a nuclear reactor plant has a reinforced annular portion at the inlet and/or outlet and anchoring means provided on the annular portion and on the foundation to allow for limited movement of the housing relative to the foundation in response to development of major stresses which are likely to arise in the event of breakage of one or more pipes or as a result of earth tremors. The inertia of the annular portion or portions in response to temperature changes can be reduced by forming their end faces with one or more circumferentially complete grooves which surround the adjacent ends of the respective pipes. The anchoring means may comprise cylindrical pins which extend radially from the respective annular portion and into complementary sockets provided on clamps, claws or analogous anchoring parts in or on the foundation. The anchoring means may also comprise L-shaped clamps which are secured to the foundation and extend into a circumferential groove of the respective annular portion or overlie a ring-shaped projection of such annular portion.

15 Claims, 8 Drawing Figures

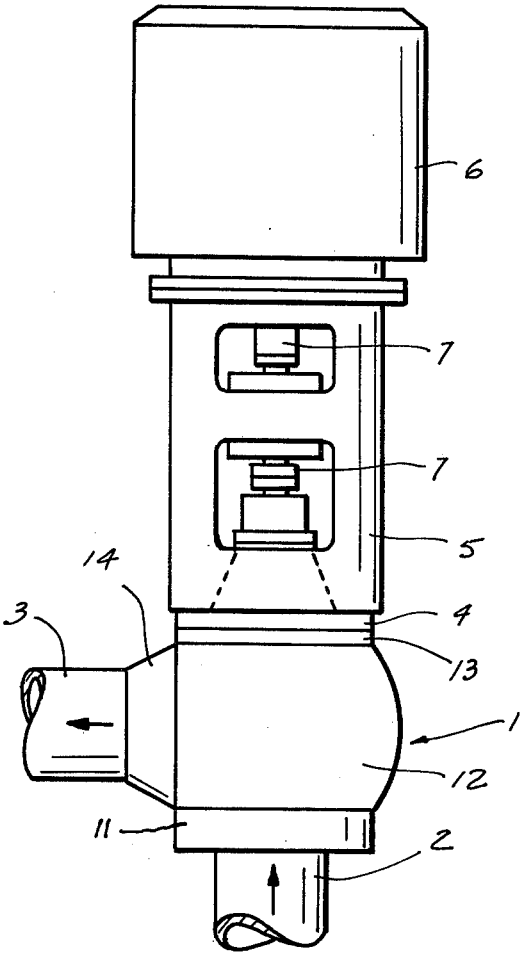
FIG. 1
FIG. 2
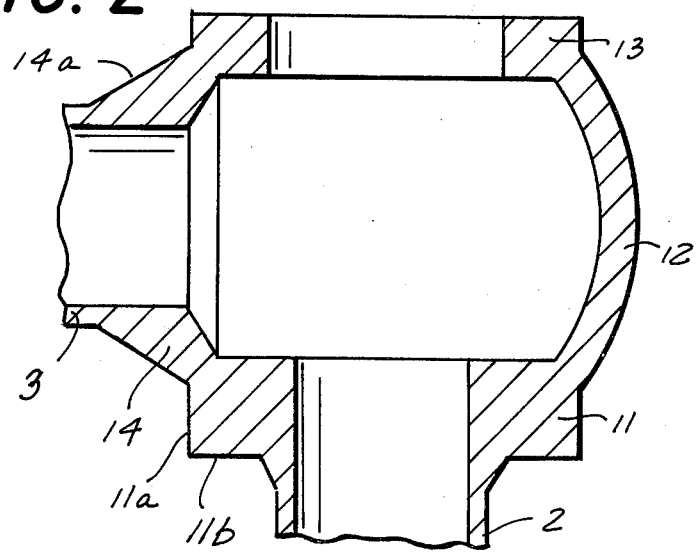
FIG. 3
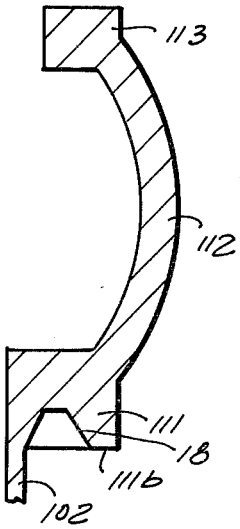

FIG. 4
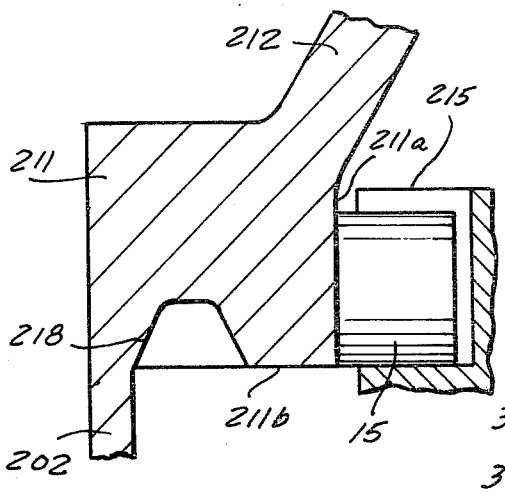
FIG. 5
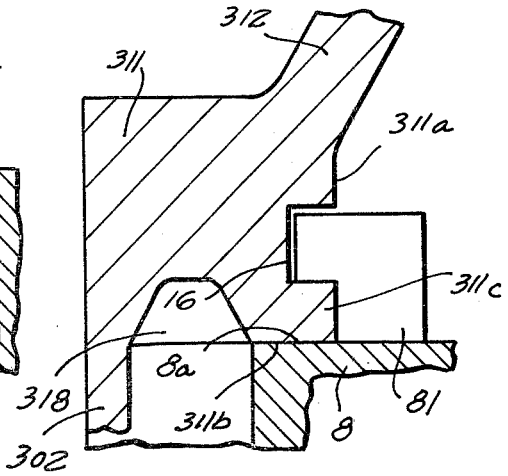
FIG. 6
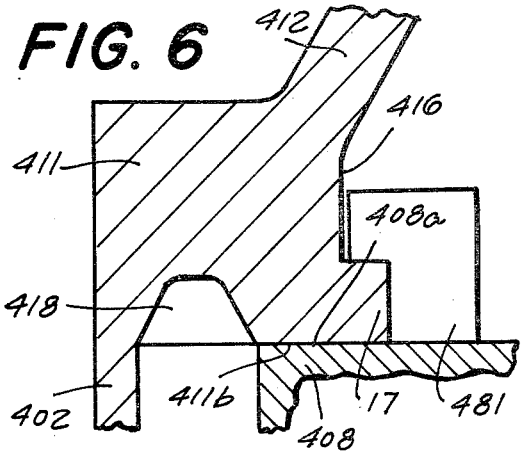
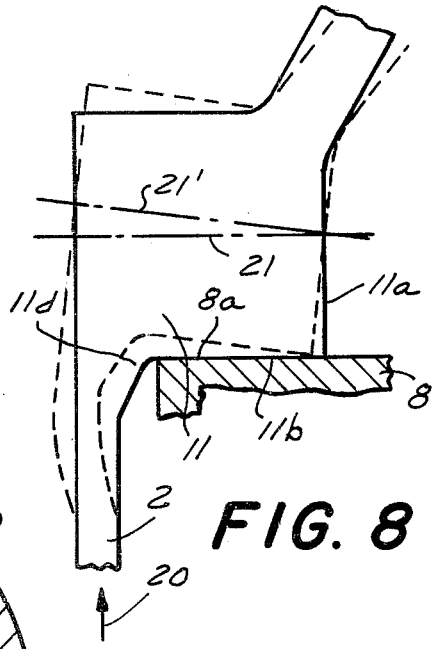
FIG. 8
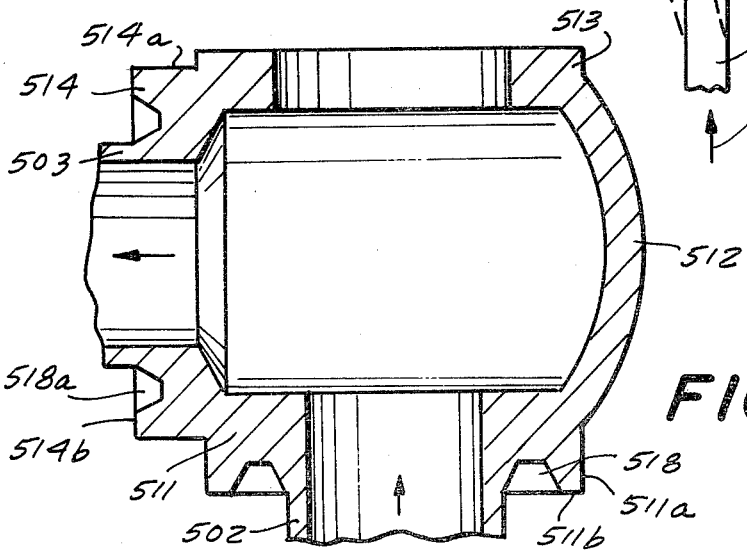
FIG. 7

PUMP FOR USE IN NUCLEAR REACTOR PLANTS AND ANCHORING MEANS THEREFOR

BACKGROUND OF THE INVENTION

The present invention relates to pumps in general, and more particularly to improvements in pumps which subject a fluid to and/or convey a fluid at very high pressures and/or temperatures. Typical examples of such pumps are primary recirculating pumps for pressurized water or boiling water reactors.

Pumps for use in nuclear power stations impose extremely strict requirements regarding the design, materials, manufacturing and quality assurance. such pumps operate at high system pressures and temperatures. The levels of radiation are high and, therefore, the pumps are confined in so-called containments which interfere with accessibility to the pumps, not only when the plant is in operation but also for servicing during the intervals of idleness. All this involves considerable expenses for special design and development of such pumps. Extraordinary measures are necessary to insure safety and reliability under all foreseeable circumstances and each unit must be tested extensively prior to delivery to the locale of use.

The first requirement which a nuclear reactor plant must satisfy is the provision of an enclosure, known as containment, which completely confines the pump, its motor, the pipes for circulating fluid and the steam generating vessel. This containment is to remain intact even in the event of a disaster of maximum forceable proportions. Such a disaster can arise in the unlikely event of complete breakage of a main coolant conveying pipe. Even a complete breakage of such pipe at right angles to its axis or a longitudinally extending crack with an area twice the cross-sectional area of the pipe must be controlled without fail, and the ability of the system to stand up under such disastrous circumstances must be proven to authorities beyond any reasonable doubt.

In a pressurized water reactor, the primary water is maintained at a pressure of up to and in excess of 150 bars and at a temperature of about 300° C. A leak, e.g., the breakage of a main water pipe, results in the release of extremely large forces in the range of 1,000 megaponds (one pond is a unit of force equal to 9.80665 $mg/s^2$). The forces which are released in the event of a disaster in a nuclear reactor plant will be more readily appreciated by considering that a reactor vessel (boiler) weighs about 500 megaponds and the pump and its motor together weigh between 70–100 megaponds, depending on their ratings. If the aforementioned forces act at right angles to the axis of a cracked or broken pipe, they generate bending stresses which are likely to result in plastic buckling. This can cause moments in the range of 3,000–5,000 Mpm, and such moments act on the pump which is normally welded into the piping. Moments in the range of 3–5 Mpm are normally considered as a very substantial stress upon the supports for the pump. Consequently, and in the absence of reliable precautionary measures, stresses of the above outlined magnitude are likely to rip one or more major components from the piping and the anchoring means therefor and to accelerate the separated components to the extent which is likely to result in penetration into and through the containment. Presently known devices which are used to prevent such separation of one or more major components employ shackles which are intended to hold the pipes, pump, motor and other components in place.

Another factor which must be considered in the design and anchoring of components of nuclear reactor plants is the possibility of earthquakes. The regulations governing the design of nuclear reactor plants provide that the plant must be capable of operating and/or of coming to a safe stop in the course of an earthquake. From the standpoint of vibration, a nuclear steam generating plant constitutes an elastically supported spatial multiple-mass oscillating system which, in the absence of preventive measures, would be likely to oscillate in synchronism with the waves developing in the course of an earthquake. In the event of vibrations caused by an earthquake, the heavier components of the system, such as the steam generators and the boiler, which are connected to each other by relatively small main coolant conveying pipes, would be likely to subject such pipes to extremely high stresses which could damage the pipes.

Attempts to counteract the consequences of tremors include such selection of characteristic frequencies of various components of a nuclear reactor plant that the frequency is well above the upper limit of the anticipated earthquake spectrum. Such measures also include the use of shackles which can perform their function only if they consist of extremely rigid ports. This cannot be readily achieved because the elements of such devices should not prevent heat expansion of the piping which is normally in the range of several centimeters.

The pump of a nuclear reactor plant is directly connected to the piping and is thus subjected to the stresses acting on the main components including the boiler and steam generator means. The lever action is likely to further enhance the effect of such stresses upon the pump. The radius of the pump is normally substantially less than the radius of a main component (e.g., 1 meter as compared with 2 meters in the case of the steam generator); therefore, the amplification of forces due to lever action upon the pump is very pronounced. If such stresses are to be resisted by anchoring means employing claws or the like, the claws must act on a relatively thin pump body. In certain instances, the stresses to which the housing of a pump is subjected by the anchoring means greatly exceed the pressure in the interior of the pump, and such stresses are not always localized but are likely to act upon a substantial or major part of the pump housing. Consequently, the housing of the pump must be designed with a view to withstand stresses which arise in normal operation as well as to withstand all such stresses which are likely to arise in the event of a major disaster including pronounced leakage and earthquakes. Indiscriminate strengthening of the pump housing for the purpose of considering such eventuality could result in the generation of excessive stresses due to changes in temperature, and such stresses could reach a value at which they would adversely affect the pumping action under normal operating conditions.

SUMMARY OF THE INVENTION

An object of the invention is to provide a novel and improved pump for use in nuclear reactor plants and to construct and assemble the housing of the pump in such a way that the pump will operate properly under normal or nearly normal conditions as well as that it can stand any and all stresses which develop as a result of an accident and/or a disaster of any foreseeable proportions.

Another object of the invention is to provide novel and improved anchoring means for the housing or body of a pump in a nuclear reactor plant.

A further object of the invention is to provide a pump housing and anchoring means which are capable of standing all anticipated stresses and are designed to allow for expansion or contraction in response to temperature changes as well as to satisfy the most exacting requirements regarding the safety of nuclear reactor plants.

An additional object of the invention is to provide a pump housing and anchoring means therefor which are designed to properly balance the effects of temperature changes, the effects of potential accidents or disasters of any foreseeable proportions, as well as the requirements regarding the safety reliability, accessibility and compactness.

Another object of the invention is to provide a relatively inexpensive pump housing and anchoring or retaining means therefor which are satisfactory from the viewpoint of the manufacturer as well as from the viewpoint of the designer of nuclear reactor plants and which more than satisfy the existing requirements as to safety so that they can be used even if such requirements should become more stringent than heretofore.

A further object of the invention is to provide a pump housing and anchoring means therefor which can be used in existing nuclear reactor plants as well as in future plants which might differ substantially from presently known plants.

The invention is embodied in a fluid displacing apparatus, especially in a primary recirculating system for use in nuclear reactor plants. The apparatus comprises a centrifugal pump having a housing including a preferably spherical hollow main section and at least one annular portion integral with the main section and serving for admission or evacuation of a fluid, a pipe which is rigid with the annular portion, a foundation or an analogous support, and anchoring means including cooperating first and second parts respectively provided on or in the annular portion and on or in the support for securing the annular portion to the support with limited freedom of movement in at least one direction, e.g., for limited freedom of movement radially and/or axially of the annular portion.

The first part of the anchoring means may comprise a plurality of cylindrical pin-shaped projections extending radially outwardly from the annular portion and into suitable sockets provided therefor in the second part of the anchoring means so that the pump housing is movable radially and/or axially of the annular portion. It is equally within the purview of the invention to employ anchoring means having a first part which constitutes a ring-shaped radially outwardly extending projection on the annular portion and a second part including several clamps each of which is fixedly secured to the support and each of which has a portion overlapping or overlying the ring-shaped projection. Inversely, the first part of the anchoring means may comprise a circumferential groove provided in the periphery of the annular portion and the second part of the anchoring means then comprises a plurality of clamps secured to the support and having portions extending into the circumferential groove.

The annular portion of the pump housing is preferably thicker than the main section and/or the pipe and is preferably provided with at least one circumferentially complete groove to enhance its deformability in response to temperature changes, i.e., to reduce the inertia of the annular portion so that the deformation (expansion and/or contraction) of the annular portion does not lag too far behind the deformation of the adjoining parts of the pump housing and the pipe.

The aforementioned annular portion may constitute an inlet portion which admits fluid into the housing or an outlet portion for evacuation of fluid from the housing. It is equally within the purview of the invention to provide the housing with two identical, similar or different annular portions one of which is connected with a pipe for admission of fluid and the other of which is connected with a fluid evacuating pipe. The axes of the two annular portions may make an angle of 90° and may intersect each other. The shaft of the prime mover which drives the impeller of the pump preferably extends into the housing through a ring-shaped flange which is preferably coaxial with but spaced apart from one of the annular portions, preferably from that annular portion which is connected with the pipe that supplies fluid into the housing.

The novel features which are considered as characteristic of the invention are set forth in particular in the appended claims. The improved apparatus itself, however both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

FIG. 1 is a fragmentary schematic elevational view of a portion of a nuclear reactor plant including a pump which embodies one form of the invention;

FIG. 2 is an enlarged vertical sectional view of the housing of the pump shown in FIG. 1;

FIG. 3 is a fragmentary vertical sectional view of the housing of a second pump;

FIG. 4 is a fragmentary vertical sectional view of the housing of a third pump, further showing a portion of first anchoring means for the housing;

FIG. 5 is a similar fragmentary sectional view of the housing of a fourth pump, further showing modified anchoring means for the housing;

FIG. 6 is a similar fragmentary vertical sectional view of the housing of a fifth pump, further showing still another anchoring means for the housing;

FIG. 7 is a fragmentary vertical sectional view of the housing of a sixth pump wherein the inlet portion is identical with or similar to the outlet portion; and FIG. 8 is an enlarged view of a detail of FIG. 2, showing the manner in which the inlet portion is deformed in response to transmission of axial stresses by way of the respective pipe.

DESCRIPTION OF THE PREFERRED EMBODIMENTS

FIG. 1 shows an aggregate including a centrifugal pump 1 having a housing or body including an annular inlet portion 11 which is welded to a coolant supplying pipe 2, an annular outlet portion 14 which is welded to a coolant discharging pipe 3, a substantially spherical main housing section 12 which is rigid with the annular portions 11, 14, and a ring-shaped portion or flange 13 which is connected to the lower end portion of a cylindrical or substantially cylindrical envelope 5. The pump 1 is mounted at a level below a motor 6 having a shaft 7 which extends through the envelope 5 and drives the impeller (not shown) in the housing section 12. The manner in which the shaft 7 is journalled in bearing means provided therefor in the envelope 5 is preferably similar to that disclosed in the commonly owned copending application Ser. No. 432,343 filed Jan. 10, 1974 by Peter Stech now U.S. Pat. No. 3,949,567 or in the commonly owned copending application Ser. No. 426,629 filed Dec. 12, 1973 by Honold et al now U.S. Pat. No. 3,918,272.

The part 4 shown in FIG. 1 constitutes a sealing casing between the flange 11 of the housing section 12 and the envelope 5. The axis of the annular portion 11 is shown as being normal to and intersects the axis of the annular portion 14. The flange 13 is concentric with the annular portion 11.

The annular inlet portion 11 constitutes an integral part of the housing section 12 in the region of the discharge end of the pipe 2 and, if produced separately, is preferably welded to 12. As shown in FIG. 2, the inlet portion 11 has a relatively large cylindrical peripheral surface 11*a* as well as a relatively large lower end face 11*b* which can directly or indirectly bear against a support or foundation (see the part 8 in FIG. 6) to withstand or transmit substantial stresses. The parts 11–14 together constitute the aforementioned pump housing or body which, with suitable variations in size and/or shape, can be used in a variety of nuclear reactor plants as a main component part of a primary recirculating pump.

In FIGS. 1 and 2, the annular inlet portion 11 of the pump housing is a solid ring having an uninterrupted cylindrical peripheral surface 11*a* and a flat uninterrupted end face 11*b*. The outlet portion 14 is also a ring-shaped part whose peripheral surface 14*a* tapers in a direction toward the pipe 3. In FIG. 3, the end face 111*b* of the annular inlet portion 111 has a circumferentially complete concentric annular recess or groove 18 whose width decreases in a direction toward the spherical main section 112. The flange is shown at 113, and the fluid supplying pipe at 102.

FIG. 4 shows a portion of a pump housing with an annular inlet portion 211 having in its end face 211*b* a groove or recess 218. Several radial anchoring projections 15 in the form of cylindrical pins extend outwardly from the peripheral surface 211*a*. The foundation (not shown in FIG. 4) has complementary anchoring means which engage the pins 15 and permit the pump housing of FIG. 4 to perform movements radially and/or axially of the inlet portion 211. Such construction of anchoring means allows for substantial expansion or contraction of the pump housing in response to temperature changes while at the same time enhancing the rigidity and resistance to very pronounced stresses. FIG. 4 shows, by way of example, a portion of complementary anchoring means 215 which allows the illustrated projection 15 to move therein radially and axially of the inlet portion 211 but holds the latter against turning about the axis of the pipe 202. The annular portion 211 is integral with the main housing section 212.

The cylindrical projections 15 can be replaced by claws and/or clamps of circular, oval or polygonal cross-sectional outline, and the complementary anchoring means is then modified accordingly to permit limited movements of the inlet portion 211 in one or more directions. The annular groove 218 is closely adjacent to the pipe 202.

In FIG. 5, the inlet portion 311 of the pump housing including the main section 312 has a circumferentially complete groove 16 in the cylindrical peripheral surface 311*a* and an end face 311*b* the outer portion of which abuts directly against an annular support or foundation 8. The foundation 8 is rigidly connected with complementary anchoring means in the form of L-shaped clamps 81 (only one shown) extending into the groove 16. In this embodiment of the pump housing, the ring-shaped part 311*c* and the groove 16 of the annular inlet portion 311 are a functional equivalent of the anchoring projections 15; they cooperate with the clamps 81 to urge the end face 311*b* against the foundation 8 but to allow the inlet portion 311 to move radially to the extent determined by the depth of the groove 16 and the length of the horizontal legs of the clamps 81. Thus, the end face 311*b* is slidable along but normally cannot move away from the adjacent surface 8*a* of the foundation 8. The groove 318 in the end face 311*b* is inwardly adjacent to the surface 8*a* of the annular foundation 8. The fluid supplying pipe is shown at 302.

FIG. 6 shows a modification of the structure of FIG. 5. The annular inlet portion 411 has a ring-shaped anchoring projection 17 which is overlapped by one leg of a complementary anchoring means or clamp 481 secured to the support or foundation 408. The groove 416 extends from the anchoring projection 17 and all the way to the main section 412 of the pump housing. The end face 411*b* of the inlet portion 411 has a groove 418 which is inwardly adjacent to the surface 408*a* of the annular foundation 408. The supply pipe is shown at 402.

FIG. 7 shows that the annular inlet portion 511 can be identical with the annular outlet portion 514. Thus, each of these annular portions has a cylindrical peripheral surface 511*a*, 514*a*, an end face 511*b*, 514*b*, and a circumferentially complete groove 518, 518*a* in the respective end face 511*b*, 514*b*. It is equally within the purview of the invention to make the inlet portion similar to the outlet portion 14 of FIG. 2 and to make the outlet portion similar to the inlet portion of FIG. 2, 3, 4, 5 or 6. The two pipes are shown at 502, 503, the main housing section at 512, and the flange at 513.

As a rule, the thickness of the annular inlet and/or outlet portion greatly exceeds the thickness of the main section of the pump housing. For example, the thickness of the annular portion 511 or 514 shown in FIG. 7 (as considered in the radial direction of the respective pipe 502, 503), may be a whole multiple of the thickness of the main section 512. This enables the annular portions 511, 514 to withstand extremely high stresses which are being or might be transmitted thereto by the pipes 502, 503. For the same reason, the thickness of the inlet and/or outlet portion is preferably a multiple of the thickness of the respective pipe. As shown in FIG. 7, the thickness of the annular portion 511 is about five times the wall thickness of the pipe 502, and this also applies for the annular portion 514 and pipe 503.

The just discussed provision that the thickness of the annular inlet and outlet portions exceed the thickness of the pipes and main section of the pump housing entails that the rate at which the dimensions of the inlet and/or outlet portions vary in response to temperature changes is much less pronounced than in the case of piping and/or main housing section. This generates stresses whose magnitude is a function of the extent and velocity of temperature changes as well as of the dimensions and configuration of the inlet and/or outlet portion. In many presently known nuclear reactor plants, the dimensions of the pumps are such that the just discussed thermally induced stresses are likely to reach the upper limit of a permissible range. Such thermally induced stresses are often compounded by so-called secondary stresses which are induced by external forces and cause the generation of peak stresses, especially in the region where the inlet or outlet portion is joined with the respective pipe. For example, and as shown in FIG. 8, the pipe 2 is likely to transmit to the annular inlet portion 11 very pronounced axial stresses acting in the direction of arrow 20. This causes the annular portion 11 to undergo a deformation, i.e., to move from the solid-line to the broken-line position of FIG. 8. The end face 11*b* moves away from the surface 8*a* of the foundation 8 and the neutral chord or plane 21 of the annular portion 11 moves to the position 21'. It will be noted that the neutral plane 21 is shifted in the axial but not in the radial direction of the annular inlet portion 11. However, the force acting in the direction of arrow 20 causes the material of the inlet portion 11 above the neutral plane 21 (in the position 21') to move radially outwardly as well as to move axially (upwardly, as viewed in FIG. 8). The extent of radial deformation above the neutral plane 21 (in the position 21') is proportional to the distance from this plane. The situation is different at a level below the neutral plane 21, i.e., the material of the inlet portion 11 is deformed radially inwardly and axially (upwardly) again to the extent which is proportional to the distance of a selected part of the portion 11 from the neutral plane.

The conical section 11*d* which constitutes a transition between the pipe 2 and annular inlet portion 11 and which is rigid with the portion 11 is forced to move inwardly (toward the axis of the pipe 2) to an extent exceeding that of inward movment of the material in the region of the end face 11*b* and the edge between the surface 11*a* and end face 11*b*. As shown, the extent of radial deformation is most pronounced in the region of the section 11*d*; this generates pronounced circumferential stresses which counteract and are likely to overcome restraining or balancing forces acting in the opposite direction. It has been found that such circumferential stresses can be reduced to a surprising degree by forming the end face 11*b* of the inlet portion 11 with a groove, such as the groove 18 of FIG. 3. This groove also reduces the extent of radial deformation above and below the neutral plane 21. Such phenomenon can be explained by the fact that the groove in the end face of the annular inlet portion reduces the heat storing capacity of the inlet portion and thus enables the inlet portion to react more rapidly to changes in the temperature of water. Such configuration of the inlet portion is desirable in spite of the fact that the groove 18 renders the inlet portion more susceptible to changes in shape in response to less pronounced stresses resulting from temperature changes. The groove 18 further shifts the transition between the pipe 2 and the inlet portion 11 nearer to the neutral plane 21 to thus reduce the extent of radial (inward) deformation of the section 11*d* in response to the application of a force acting in the direction of arrow 20. It has been found that the groove 18 is desirable in inlet portions forming part of extremely large, medium-sized and/or relatively small pump housings.

The observations made in connection with FIG. 8 apply with equal force for the outlet portion, particularly if the latter is configurated in a manner as shown in FIG. 7.

One of the primary functions of the annular inlet and outlet portions of the improved pump housing is to take up loads or stresses tending to break the respective pipes as well as to transmit such stresses to the support. The provision of grooves 18 or analogous grooves is particularly desirable in inlet and/or outlet portions of large pump housings. An advantage of the improved apparatus including the pump, its housing and the anchoring means therefor is that the designer of the plant has substantial freedom of standardizing the basic design of the pump housing and the anchoring means. The anchoring means is simple and inexpensive and can contribute to an increase of the characteristic frequency of the steam generating plant. The loads which the pump housing and the anchoring means can sustain are so high that one can dispense with any and all auxiliary supporting and anchoring devices for the piping in order to protect the pump against stresses in the event of an accident of minor or major proportions. The housing of the pump is readily accessible for inspection, also when the plant is in use, and its cost does not exceed the cost of housings which are secured to the foundation or other support by conventional anchoring means. Also, the deformation of the annular inlet or outlet portion does not unduly affect the operation of the pump so that such deformation can take place while the pump remains in operation or while the moving parts of the pump are being brought to a gradual stop, i.e., the pump can continue to convey coolant while the annular inlet or outlet portion undergoes a very pronounced deformation and transmits stresses to the adjacent part or parts of the support.

Without further analysis, the foregoing will so fully reveal the gist of the present invention that others can, by applying current knowledge, readily adapt it for various applications without omitting features which fairly constitute essential characteristics of the generic and specific aspects of our contribution to the art and, therefore, such adaptations should and are intended to be comprehended within the meaning and range of equivalence of the claims.

What is claimed as new and desired to be protected by Letters Patent is set forth in the appended

1. In a fluid displacing apparatus, particularly in a primary recirculating system for nuclear reactor plants, a combination comprising a centrifugal pump having a housing including a hollow main section and an annular portion integral with said main section; a pipe rigid with said annular portion; a support; and anchoring means including cooperating first and second parts respectively provided on said annular portion and said support for securing said annular portion to said support with limited freedom of movement in at least one direction.

2. A combination as defined in claim 1, wherein said first part of said anchoring means comprises a plurality of cylindrical projections extending radially outwardly from said annular portion.

3. A combination as defined in claim 1, wherein said first part of said anchoring means comprises a ring-shaped radially outwardly extending projection on said annular portion and said second part of said anchoring means comprises a plurality of clamps each secured to said support and each having a portion overlapping said projection.

4. A combination as defined in claim 1, wherein said first part of said anchoring means comprises a circumferential groove provided in the periphery of said annular portion and said second part of said anchoring means comprises a plurality of clamps secured to said support and having portions extending into said groove.

5. A combination as defined in claim 1, wherein said annular portion comprises an end face which abuts against a complementary surface of said support.

6. A combination as defined in claim 1, wherein said annular portion is provided with at least one circumferentially complete groove to enhance the deformability of said annular portion in response to temperature changes.

7. A combination as defined in claim 6, wherein said annular portion has an end face and said groove is provided in said end face.

8. A combination as defined in claim 1, wherein the thickness of said annular portion, as considered in the radial direction thereof, exceeds the wall thickness of said pipe and said main section.

9. A combination as defined in claim 1, wherein said pipe is arranged to admit a fluid into said main section by way of said annular portion.

10. A combination as defined in claim 1, wherein said pipe is arranged to evacuate fluid from said main section by way of said annular portion.

11. A combination as defined in claim 1, wherein said housing further comprises an annular flange substantially coaxial with said annular portion and rigid with said main section, and further comprising a prime mover having a rotary output element extending into said main section through said flange.

12. A combination as defined in claim 1, wherein said main section is a hollow sphere and said housing further comprises a second annular portion whose axis is inclined with respect to the axis of said first mentioned annular portion, and further comprising a second pipe rigid with said second annular portion.

13. A combination as defined in claim 12, wherein said second annular portion is identical with said first mentioned annular portion.

14. A combination as defined in claim 12, wherein at least one of said annular portions has at least one concentric circumferentially complete groove.

15. A combination as defined in claim 12, wherein the axes of said annular portions make an angle of 90°.

* * * * *